United States Patent [19]

Langheck

[11] Patent Number: 4,520,365

[45] Date of Patent: May 28, 1985

[54] TELESCOPING ANTENNA WITH ACTUATING GEAR DRIVEN CABLE

[75] Inventor: Richard Langheck, Neubärental, Fed. Rep. of Germany

[73] Assignee: Wilhelm Sihn Jr. KG., Niefern-Oschelbronn, Fed. Rep. of Germany

[21] Appl. No.: 454,342

[22] Filed: Dec. 29, 1982

[30] Foreign Application Priority Data

Jan. 9, 1982 [DE] Fed. Rep. of Germany ..... 3200444

[51] Int. Cl.[3] ..... H01Q 1/10; H01Q 1/32

[52] U.S. Cl. ..... 343/903

[58] Field of Search ..... 343/877, 903, 901

[56] References Cited

U.S. PATENT DOCUMENTS 2,222,588 11/1940 Williams ..... 343/903
2,709,220 5/1955 Spector ..... 343/903

FOREIGN PATENT DOCUMENTS 881965 7/1953 Fed. Rep. of Germany ..... 343/903
2359270 11/1973 Fed. Rep. of Germany ..... 343/903

*Primary Examiner*—Eli Lieberman
*Attorney, Agent, or Firm*—Balogh, Osann, Kramer, Dvorak, Genova & Traub

[57] ABSTRACT

A telescoping antenna with remote control which is extended and retracted by means of a plastic wire (9) running inside the telescope is described. The wire (9) comprises cut-in slots (12) which are spaced at regular intervals all the way through and whose front surfaces (14*a*, 14*b*) are closest in the area of the neutral fiber of the wire (9). The teeth (16) of a driven toothed gear (10) mesh with the slots (12) and act practically only in the area of the neutral fiber on the wire (9) which as a result has a lesser inclination to break.

7 Claims, 3 Drawing Figures

TELESCOPING ANTENNA WITH ACTUATING GEAR DRIVEN CABLE

Starting point of the invention is a telescoping antenna having the features recited in the preamble of claim 1. Such a telescoping antenna is known from German Pat. No. 881,965. The known telescoping antenna has a flat steel band in its interior for extending and retracting, with holes along its entire length which mesh with teeth of a driven toothed gear. Also mentioned in German Pat. No. 881,965 as an alternative element for extending and retracting is a helical spring which extends inside the telescope and is moved forward or backward by means of a driven nut whose threads mesh with the threads of the helical spring, or elements not specified in detail but generally designated as sliding tongue which may be made of steel or plastic or any other material and which should be made to mesh with a drive wheel or be frictionally engaged.

The requirements for the drive of telescoping antennas for motor vehicles are characterized mainly by the necessity of creating and transmitting thrust forces of up to approximately 100N. The drive known from German Pat. No. 881,965 fails to meet this requirement reliably. When the telescoping antenna is extended, the punched steel band inside the telescope may break, particularly in the outer telescopic tubes with larger inside diameter; since the steel band's maximum width is limited by the inside diameter of the innermost, narrowest telescopic tube, the steel band has progressively more play for breaking in the outer telescopic tubes as the extended length increases. A further difficulty lies in the fact that metallic elements for extending and retracting a telescoping antenna change its electrical capacity and have therefore not been used in practical application.

The object underlying the invention is to improve the operating safety of a telescoping antenna as set forth in the preamble of claim 1, and, in particular, to enable low-friction operation of the actuating device and avoid a breaking-off of the element extending the antenna.

This object is realized in the subject matter of claim 1. Advantageous further developments of the invention constitute the subject matter of the subclaims.

The chosen shape and arrangement of the front surfaces of the slots which mesh with the profiles of the teeth of the toothed gear ensure that the teeth will only transmit the thrust force in the area of the longitudinal center line, that is to say along its neutral fiber, onto the wire, and the tendency for it to break is therefore only slight. At the same time, the concentration of the section of the front surfaces of the slots meshing with the profiles on a narrow strip in the area of the longitudinal center line of the wire simplifies shaping of the profiles in that during the entire rolling motion of a tooth on one front surface of a slot, the thrust force transmitted by the tooth in the main is only transmitted in the direction of the wire's longitudinal center line. As a result, the toothed gear attempts to displace the wire laterally with minimal force only and the wire is therefore pressed against an abutment located opposite the front surface of the toothed gear with minimal force only; the abutment is needed for the actuating device to keep the wire in mesh with the toothed gear; the abutment may be a level wall section located in tangential-parallel opposite relationship to the toothed gear, or a concave wall section which partly encloses the toothed gear; preferably, the abutment is a cylindrical wall which surrounds the toothed gear eccentrically and which, advantageously, rotates freely about its axis. The newly formed wire can move through the slot between toothed gear and abutment with only minimal friction.

The favorable effect of the slots' shape is further supplemented by an advantageous cross-sectional shape of the wire. The wire's cross-section is limited by the inside diameter of the innermost, narrowest telescopic tube and it should make the fullest possible use of the inside diameter available in order to achieve as high a degree of flexural rigidity as possible. For this reason, a wire with a round cross-section, or a cross-section approaching a round cross-section, such as hexagonal or octagonal cross-sections, is used; for reasons of ease of manufacture and of slidability, it should be made of a plastic material.

Particularly favorable with respect to ease of manufacture and function is a wire on which the front surfaces of the slots are of circular arc configuration, as defined in claim 2, in which instance the remaining claims recite the most favorable determination of safe cross-sectional dimensions for the wire.

As a material for the wire, extrusion-pressed polyformaldehyde is particularly well suited. Although notch sensitive and breakable, its rigidity is favorable for extending, and its texture extends in longitudinal direction. The slots are best cut into such a wire with the latter being moved step by step through cutting tools located in succession on either side of the wire and acting upon it.

The height of the teeth of the toothed gear which meshes with the wire should be greater than half the diameter of the wire so that the profiles can reach the neutral fiber of the wire. The height of the teeth should, however, in so far as they can submerge into the slots, not exceed the full diameter of the wire to ensure that the heads of the teeth do not protrude from the slots. The wire must be able to touch its abutment to ensure that the wire is held and guided between the toothed gear and the abutment.

An embodiment of the invention is shown schematically in the enclosed drawings.

Figure 2:
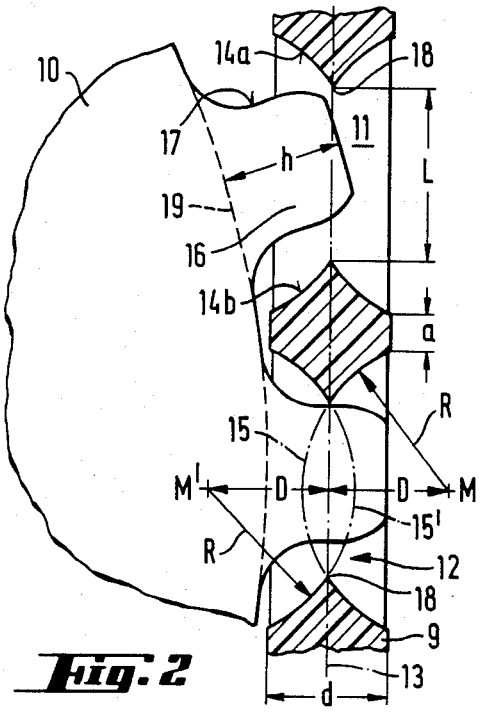
FIG. 2 shows on an enlarged scale as a detail the meshing of the driven toothed gear of the actuating device with the slotted plastic wire which is cut along the center plane of the slots containing the wire's longitudinal center line.
Figure 1:
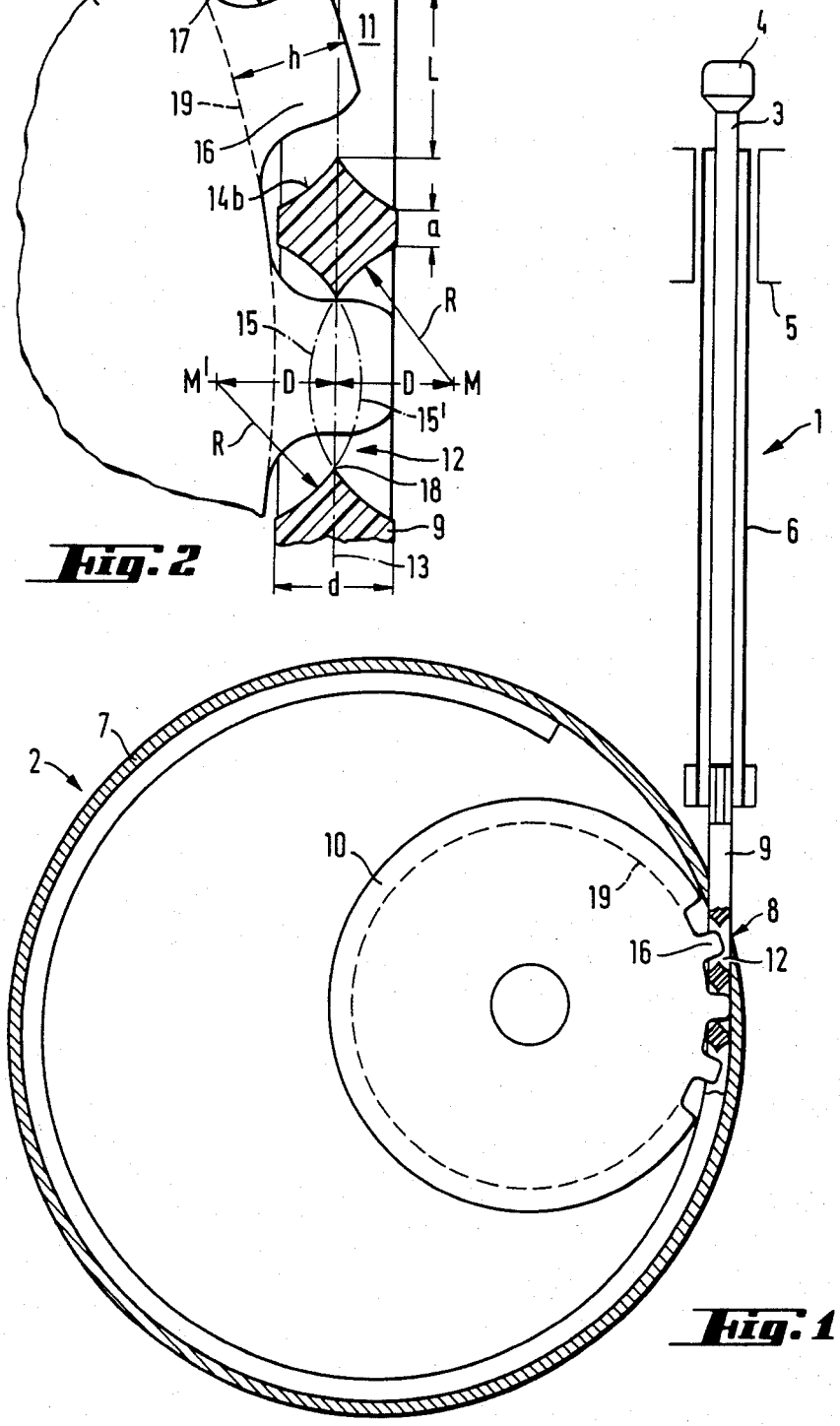
FIG. 1 shows a partly sectional view of a telescoping antenna with actuating device.
Figure 3:
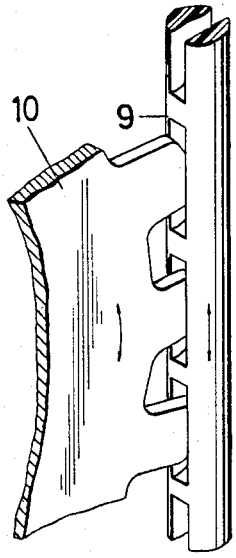
FIG. 3 shows a perspective view of a section of the plastic wire and of the toothed gear shown in FIG. 1.

FIG. 1 shows a telescoping antenna 1 with an actuating device 2. Of the telescoping antenna 1 itself, only an inside telescopic tube 3 with antenna head 4, and an outside telescopic tube 6 guided in a sleeve 5 are illustrated. Of the actuating device 2, only those parts are shown which are important for an understanding of the invention, i.e., a cylindrical housing 7 with a tangential exit opening 8 for a slotted plastic wire 9 of circular cross-section whose front end is fastened in the inside telescopic tube 3, and which can be extended as well as retracted from the housing 7 by means of a driven toothed gear 10 located eccentrically inside the housing 7.

The wire 9 is fitted with narrow slots 12 which are limited preferably by parallel areas 11 in the longitudinal direction of the wire 9, and which are arranged at regular intervals of approximately a=1.5 millimeters (measured on the wire surface) behind each other, having a width of approximately 25% of the diameter d of the wire 9. The longitudinal center line 13 of the wire 9 simultaneously runs through the longitudinal center planes of the slots 12.

The slots 12 are made by undercutting the external surface of the wire 9 to form angular surfaces 14*a* and 14*b* which terminate in spaced cusps 18.

The angular surfaces 14*a* and 14*b* of each slot 12 are substantially limited as by cylinder areas which are formed by circular arcs 15 and 15' with radius R, with their center points M and M' located at a distance D<R on both sides of the longitudinal center line 13, so that the circular arcs 15, 15', i.e., the cylindrical areas formed by them, intersect in the plane extending at right angles to the longitudinal center plane of the slots 12 and containing the longitudinal center line 13. The intersection of the circular arcs 15 and 15' define the pair of opposed cusps 18 which lie on the longitudinal center line 13. In this plane, the slots 12 have their shortest length L, extending across the opposed cusps 18, and from there on the slots increase in width in the shape of circular arcs up to the wire surface. The chosen shape of the angular surfaces 14*a*, 14*b* of the slots 12 on one hand makes room for free entry and exit of the teeth 16 of the toothed gear 10, and makes it possible for the profiles 17 to touch the angular surfaces 14*a* or 14*b* practically only in the area of the cusps 18 of the cylinder areas delimiting the angular surfaces 14*a*, 14*b*. The thrust force is therefore transmitted to the wire by the toothed gear 10 practically only along the neutral fiber of the wire 12; the limiting expression "practically" is used because the cusps 18 will, of course, wear out with use and thus get rounded off or widened.

The profile shape and the radius of the toothed gear 10 are adapted in such a way to the shape and arrangement of the slots 12 in the wire 9 that during the entire rolling motion of the profiles 17 on the cusps 18 the transmission of the thrust force occurs substantially in the direction in which the neutral fiber of the wire 9 extends.

The risk of buckling of the wire 9 can be kept extremely low by these measures in accordance with the present invention.

The wire 9 is held and guided in the housing 7 in a working aperture located near the exit opening 8 between the toothed gear 10 and the inside wall of the housing 7 which is planar in the area of the working aperture and leads in a tangential direction into the exit opening 8. The height h of the teeth 16 is slightly smaller than the diameter d of the wire 9, ensuring that with the chosen arrangement, in the working aperture, with the wire 9 abutting the inside wall of the housing 7, on the one hand, and extending down to the foot circle 19, on the other hand, the teeth 16 are just about kept from touching the housing's inside wall. The cylindrically shaped housing 7 may be arranged so as to rotate about its own axis.

I claim:

1. Telescoping antenna with actuating device for motor vehicles, extendable and retractable by means of a long flexible element which runs inside the telescope and is fitted with apertures spaced in longitudinal direction at regular intervals behind one another, which mesh with the teeth of a driven toothed gear, characterized in that the flexible element is a plastic wire with a nearly round cross-section, wherein the apertures are slots which are interspersed along the wire along a plane containing a longitudinal center line of the extended wire, each slot having a pair of spaced opposed parallel areas and a pair of angular surfaces terminating in spaced opposed cusps which lie along said longitudinal center line, the spacing L between the opposed cusps increases from the longitudinal center line, along said angular surfaces, towards the wire surface.

2. Telescoping antenna as defined in claim 1, characterized in that the slots are each delimited by two circular arcs which intersect on the longitudinal center line, center points M, M' of said circular arcs are located at a distance D from the longitudinal center line, which distance D is smaller than the radius R of the pertaining circular arc.

3. Telescoping antenna as defined in claim 2, characterized in that the ratio of the circular arc radius R to the distance D of the circular arc center point M, M' from the longitudinal center line lies in a ratio between 1.1:1 and 1.3:1, and preferably 1.14:1.

4. Telescoping antenna as defined in claim 1, characterized in that the width of the slots, between said parallel areas, in between 20% and 40%, preferably approximately 25% of the diameter d of the plastic wire.

5. Telescoping antenna as defined in claim 2, characterized in that the radius R of the circular arc is 1.0 to 1.5 times, preferably approximately 1.15 to 1.20 times the diameter d of the plastic wire.

6. Telescoping antenna as defined in claim 1, characterized in that the distance a between successive slots as measured along the surface of the wire is at least 1 mm, preferably approximately 1.5 mm.

7. Telescoping antenna as defined in claim 1, characterized in that the height h of the teeth of the toothed gear is greater than half the diameter d of the wire and no greater than the full diameter d of the wire.

* * * * *